United States Patent [19]

Van Pham

[11] 4,232,409

[45] Nov. 11, 1980

[54] PNEUMATIC ASSISTED FLUSHING APPARATUS FOR TOILETS

[76] Inventor: Minh Van Pham, 3200 Ridgewood Rd., Willits, Calif. 95490

[21] Appl. No.: 935,382

[22] Filed: Aug. 21, 1978

[51] Int. Cl.[3] ..... E03D 3/10; E03D 11/00; E03D 5/012

[52] U.S. Cl. ..... 4/362; 4/364; 4/380; 4/431; 4/433; 4/435

[58] Field of Search ..... 4/300, 328, 345, 346, 4/353, 354, 360–362, 378, 379, 380, 388, 405, 407, 420 M, 421–423, 425, 431, 434, 435, 438, 439, 441, 1, 432; 417/402; 137/205

[56] References Cited

U.S. PATENT DOCUMENTS

| | | | |
|---|---|---|---|
| 2,315,824 | 4/1943 | Sweeny | 4/435 |
| 3,154,796 | 11/1964 | Bruce | 4/431 |
| 3,214,772 | 11/1965 | Roberts et al. | 4/438 |
| 3,566,415 | 3/1971 | Culp | 4/431 |
| 3,643,265 | 2/1972 | Wiswell | 4/431 X |
| 3,698,019 | 10/1972 | Culp | 4/431 |
| 3,720,962 | 3/1973 | Harrah | 4/431 X |
| 3,732,579 | 5/1973 | Allander et al. | 4/431 |
| 3,968,526 | 7/1976 | Harrah | 4/420 |
| 3,996,628 | 12/1976 | Mollostedt | 4/433 X |
| 4,041,554 | 8/1977 | Gregory | 4/420 |

FOREIGN PATENT DOCUMENTS

| | | | |
|---|---|---|---|
| 2455551 | 5/1976 | Fed. Rep. of Germany | 4/431 |
| 2653713 | 3/1978 | Fed. Rep. of Germany | 4/431 |

*Primary Examiner*—Stuart S. Levy
*Attorney, Agent, or Firm*—John J. Leavitt

[57] ABSTRACT

Presented is an apparatus for use in conjunction with a toilet of the flush-type which utilizes a charge of compressed air in conjunction with a low volume of water to discharge waste products from a toilet fixture.

33 Claims, 13 Drawing Figures

PNEUMATIC ASSISTED FLUSHING APPARATUS FOR TOILETS

BACKGROUND OF THE INVENTION

1. Field of the Invention

This invention relates to toilet fixtures for the disposal of human waste, and more particularly to such toilet fixtures that utilize a combination of air and water to dispose of such wastes.

2. Description of the Prior Art

A search of the prior art related to this subject indicates that such prior art is located in Class 4. A search in this area has revealed the existence of six (6) United States patents as follows, U.S. Pat. Nos.:

3,720,962
3,968,526
3,698,019
3,566,415
3,214,772
3,643,265

Referring to the listed patents, it is noted that U.S. Pat. No. 3,214,772 is primarily concerned with a straight flush-type toilet as distinguished from a toilet fixture that utilizes air and water in combination to effect discharge of waste products.

U.S. Pat. No. 3,566,415 teaches the broad concept of utilizing the combination of water and air to flush waste products through a toilet fixture but the specific structure taught by this patent appears to be significantly different from the structure forming the subject matter of this invention.

U.S. Pat. No. 3,643,265 also teaches the broad concept of the utilization of air and water to effect the discharge of waste products, but the structure taught by this patent involves the use of flexible inner and outer bags coacting with applied pressure to effect such discharge, and there is therefore significant structural and operational differences between this prior art patent structure and the structure and mode of operation forming the subject matter of this invention.

U.S. Pat. No. 3,698,019 is similar in its concept to U.S. Pat. No. 3,566,415 in that it teaches the broad concept of utilizing air and water to discharge waste materials, however the structure embodied by this patent to effect this end appears to be substantially different from the structure forming the subject matter of this invention.

U.S. Pat. No. 3,720,962 teaches the concept of a partial water flush followed by an air flush but utilizes a structure significantly differently to accomplish this purpose.

Lastly, U.S. Pat. No. 3,968,526 is directed specifically to an improved control system for actuating an air cylinder which controls the opening and closing with the flushing mechanism for a toilet bowl.

One of the disadvantages that has been noted in conjunction with prior art patent structures utilizing a combination of air and water to effect discharge of human waste products from toilet fixtures with a low volume of water has been the necessity of providing extraneous apparatus such as air compressors or air cylinders to supply the air required in the flushing operation. The necessity for such extraneous apparatus results in such systems being prohibitive in cost and inconvenient to install in already existing structures. Accordingly, one of the important objections of the present invention is the provision of an air-assisted flushing system for a flush toilet which does not require such extraneous apparatus.

It is well known that most residential, commercial, and industrial water systems to which toilet fixtures are connected operate at a pressure that is significant, say from 45 psi to 90 psi. Variations in the pressure are frequently controlled by appropriate pressure control valves inserted in the inlet line of the water source. Accordingly, it is another object of the present invention to provide an air-assisted flush toilet that utilizes water pressure in the water system to which the toilet is connected to provide a charge of compressed air which may be selectively utilized to assist the flushing operation.

Many homes include multiple numbers of toilets, each connected to a common source of water. Many flush-type toilets utilize from 6½ to 8 gallons of water for each flushing operation. In recent times, it has been discovered that shortages of water for domestic use may be significantly alleviated by using less water in the flushing operation of toilet facilities. Accordingly, another object of this invention is the provision of a system incorporated into a toilet fixture to reduce the amount of water required in the flushing operation to approximately 2 quarts, thus achieving a saving of approximately 80% of the volume of water normally used in a conventional flushing operation.

Water has been designated as a natural resource that is in short supply. Since most existing residences, commercial establishments and industrial complexes are equipped with conventional toilet fixtures that utilize large volumes of water, another important object of the present invention is the provision of an air-assisted flush-type toilet that may be substituted for conventional toilets, and a control valve assembly that may be retrofitted on existing air-assisted toilet fixtures to thereby significantly decrease the use of water for the toilet flushing function.

In conventional toilets there remains in the bowl a quantity of contaminated water that constitutes a portion of the water that was left in the toilet trap after the last flushing operation. This contaminated water is mixed each time the toilet is flushed with the flush water released from the toilet tank or reservoir. The significance of this is that no matter how many times the toilet is flushed, the water that remains is a mixture of contaminated water and clean flush water. Accordingly, it is one of the objects of the present invention to provide a toilet structure in which all of the contaminated water, including waste materials, are flushed completely from the system so that whatever water remains in the base of the toilet constitutes clean uncontaminated water.

The invention possesses other objects and features of advantage, some of which with the foregoing, will be apparent from the following description and the drawings. It is to be understood, however, that the invention is not limited to the embodiment illustrated and described since it may be embodied in various forms within the scope of the appended claims.

SUMMARY OF THE INVENTION

In terms of broad inclusion, the low volume, water flush, air-assisted toilet system of the invention comprises a conventional toilet or a specially designed toilet incorporating therewith a relatively low volume water storage container appropriately connected to a control valve which is in turn connected to a domestic water supply system to supply water to the reservoir. The control valve assembly includes a housing having a pair of pistons operable by fluctuation of the water pressure associated with the flushing operation to generate air pressure and deliver such air under pressure to an evacuation chamber associated with the base of the toilet. In operation, a low volume of water is collected and retained in the bottom portion of the toilet bowl wherein waste materials are deposited. Upon flushing the toilet, an evacuation chamber gate is actuated to effect transfer of the trapped water and waste materials into a relatively small evacuation chamber disposed in the base of the toilet. Closure of the evacuation chamber gate after deposition of waste materials in the evacuation chamber effects release of high pressure air into the evacuation chamber to discharge the contents thereof into the sewage discharge line.

DESCRIPTION OF THE PREFERRED EMBODIMENT

Figure 1:
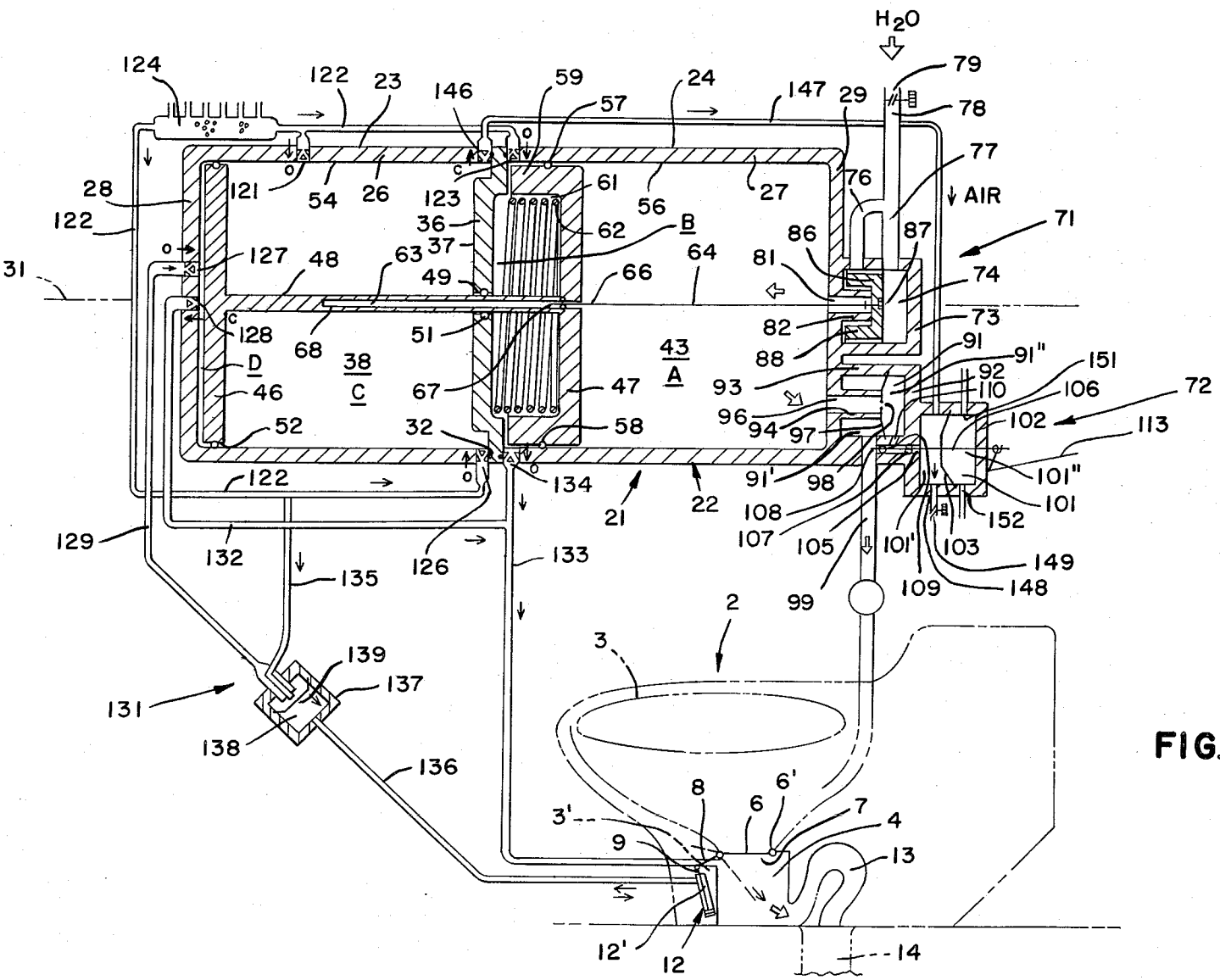
FIG. 1 is a schematic view illustrating the interconnection of the control assembly to a low water volume flush toilet fixture. The control assembly is shown in its position upon completion of the air compression portion of its cycle.

In terms of greater detail, the low volume water usage toilet apparatus and control system of the invention comprises a system that utilizes water and air in cooperation with each other to effect the flushing of waste products through a toilet fixture. Referring to FIG. 1, there is there shown schematically, a control assembly connected to a low water volume flush toilet indicated generally by the numeral 2, and including a bowl portion 3, the base 3' of which is provided with an evacuation chamber 4 disposed beneath the bowl 3 so that waste products deposited in the toilet bowl may ultimately pass into the evacuation chamber.

The toilet bowl is provided with an evacuation chamber gate 6, appropriately hinged and possessing appropriate seal means 6' to sealingly close the opening 7 between the base 3' of the toilet bowl 3 and the evacuation chamber. Means including a lever arm 8 are provided connected to the evacuation chamber gate 6 at one end while its opposite end is connected to the plunger 9 of a spring-loaded vacuum cylinder 12 arranged to normally keep the evacuation chamber gate 6 closed by spring pressure exerted by spring 12' and arranged to selectively open the chamber gate by application of negative pressure or vacuum to the cylinder when it is desired to transfer water and waste products from the toilet bowl into the evacuation chamber. Preferably, the air cylinder is constructed with a by-pass that automatically relieves the vacuum after full excursion of the plunger, thus causing the spring to again close and seal the gate opening between the toilet bowl and evacuation chamber.

The evacuation chamber is also provided with a generally U-shaped trap 13 which in some instances, depending upon code requirements, may be omitted, but which for the sake of satisfying some existing code requirements, may be included without deleterious effect. The U-shaped trap is connected at one end to the evacuation chamber and at its other end communicates with a sewage discharge line 14 as is customarily used to carry waste products to an appropriate sewerage system.

The system described above is similar in some respects to systems already available on the market which utilize a combination of air and water to flush waste products into a sewerage system or other disposition means such as a septic tank. Most such conventional air-water toilet systems, require the utilization of an air compressor and appropriate drive motor for actuating the compressor to provide the supply of air utilized in the flushing operation. The disadvantage of such conventional systems includes the cost of the initial equipment to provide a source of air, the difficulty with such a system is plumbed into existing structures, and the noise created by such systems when the motor and compressor are activated. Another disadvantage is the possibility of the system being rendered inoperative by a power failure, thus rendering the compressor inactive, and resulting in the collection of unwanted waste products in the toilet bowl because of the inability to flush such products away.

The subject matter of this invention obviates all of these difficulties because it utilizes water pressure from the usually present source for such water to provide the source of air that, at an appropriate time, is channeled into the evacuation chamber so as to cause all of the waste products collected therein to be carried into the sewerage system.

To effect this result, structurally speaking, there is provided a pressure exchanger designated generally by the numeral 21, the pressure exchanger including a housing designated generally by the numeral 22. The housing is preferably formed by two separate sections 23 and 24, each preferably being circular in configuration and including, respectively, cylindrical walls 26 and 27 closed at opposite ends by end walls 28 and 29. The separable sections 23 and 24 are thus generally cup-shaped and arranged coaxially about a longitudinal axis 31 with the open end of each separable section being disposed adjacent the open end of the other section. Through appropriate seal means which may be in the form of an "O" ring 32 recessed into an appropriate groove 33 formed in the end edge 34 of the separable section 23, there is provided a fluid tight relationship between the open end of this separable section and an associated transversely extending wall 36. One surface 37 of the wall faces into the interior chamber 38 of the separable section 23, and more specifically faces into the cylindrical cup-shaped chamber formed by cylindrical wall 26 and end wall 28.

In like manner, the cylindrical cup-shaped separable section 24, including the cylindrical wall 27 and end wall 29, has its open end facing the open end of the separable section 23, but from the opposite side of wall 36, and is provided with a seal ring 39 conveniently comprised of an "O" ring seated in an appropriate groove 40 formed in the end edge 41 of the cylindrical wall 27. Any suitable means may be utilized to sealingly clamp the separable sections 23 and 24 to the opposite surface 37 and 42 of the transversely extending intermediate wall 36. It will thus be seen that there is formed between the transverse wall 36 and the end wall 29 and cylindrical wall 27 a chamber 43 similar to the chamber 38 on the opposite side of the transverse intermediate wall 36.

Mounted within the housing 21 is a double-ended piston assembly including a piston 46 reciprocably mounted within the chamber 38 formed by separable cup-shaped section 23, and a piston 47 reciprocably mounted within the chamber 43 formed by separable cup-shaped section 24. The pistons 46 and 47 are rigidly interconnected by a shaft 48 that is centrally disposed along the longitudinal axis 31 so that when piston 46 is displaced in one direction the piston 47 perforce is displaced in the same direction. To effect such interconnection of the pistons 46 and 47, inasmuch as these pistons are enclosed within separate chambers 38 and 43, respectively, separated by the transverse intermediate wall 36, there is provided centrally disposed in the transverse wall 36 an appropriate bearing aperture or bore 49 provided with an "O" ring seal 51 through which the shaft 48 sealingly and slidably extends. The piston 46 is provided with a peripheral edge 52 grooved to receive an "O" ring seal 53 thereabout which sealingly and slidably engages the inner periphery 54 of the cylindrical wall 26. In like manner, the piston 47 is sealingly and slidably related to the inner peripheral wall 56 of the cylindrical wall 27 by an "O" ring 57 appropriately seated in a seal groove 58 formed in a skirt portion 59 integrally formed adjacent the outer periphery of the piston 47.

Figure 2:
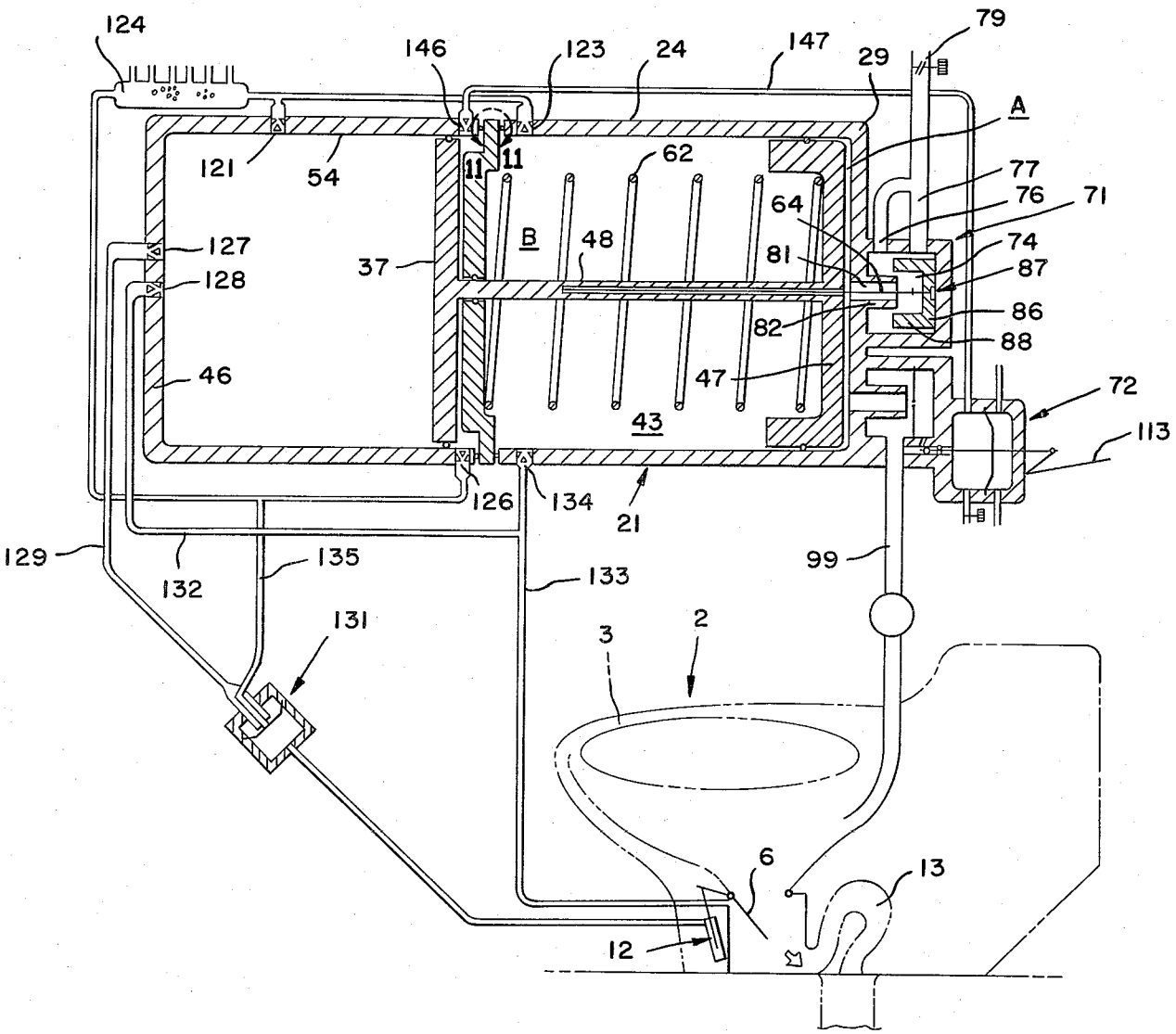
FIG. 2 is a schematic view similar to FIG. 1, but showing the control assembly in its position upon completion of the water delivery portion of its cycle.
Figure 3:
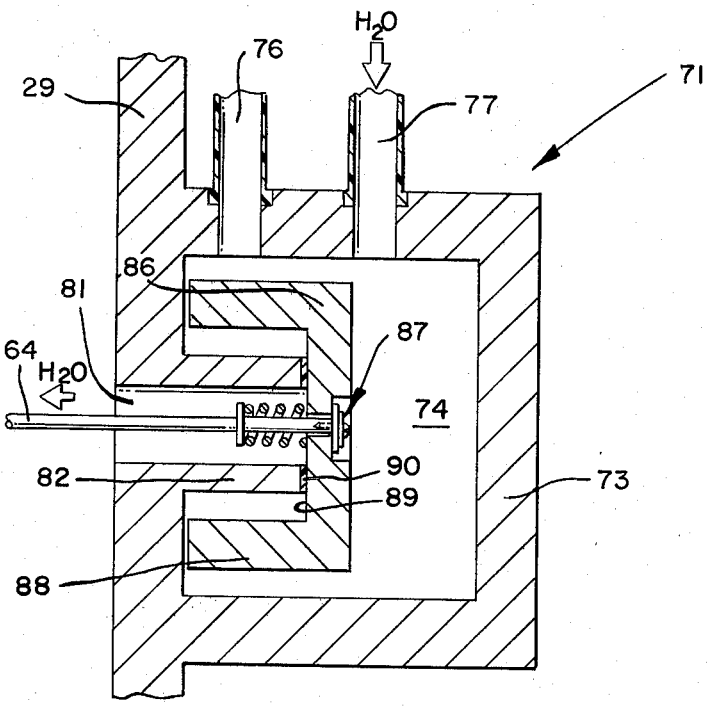
FIG. 3 is a fragmentary cross-sectional schematic view in enlarged scale illustrating the structural and functional relationships embodied in the regenerating valve assembly of the invention.
Figure 4:
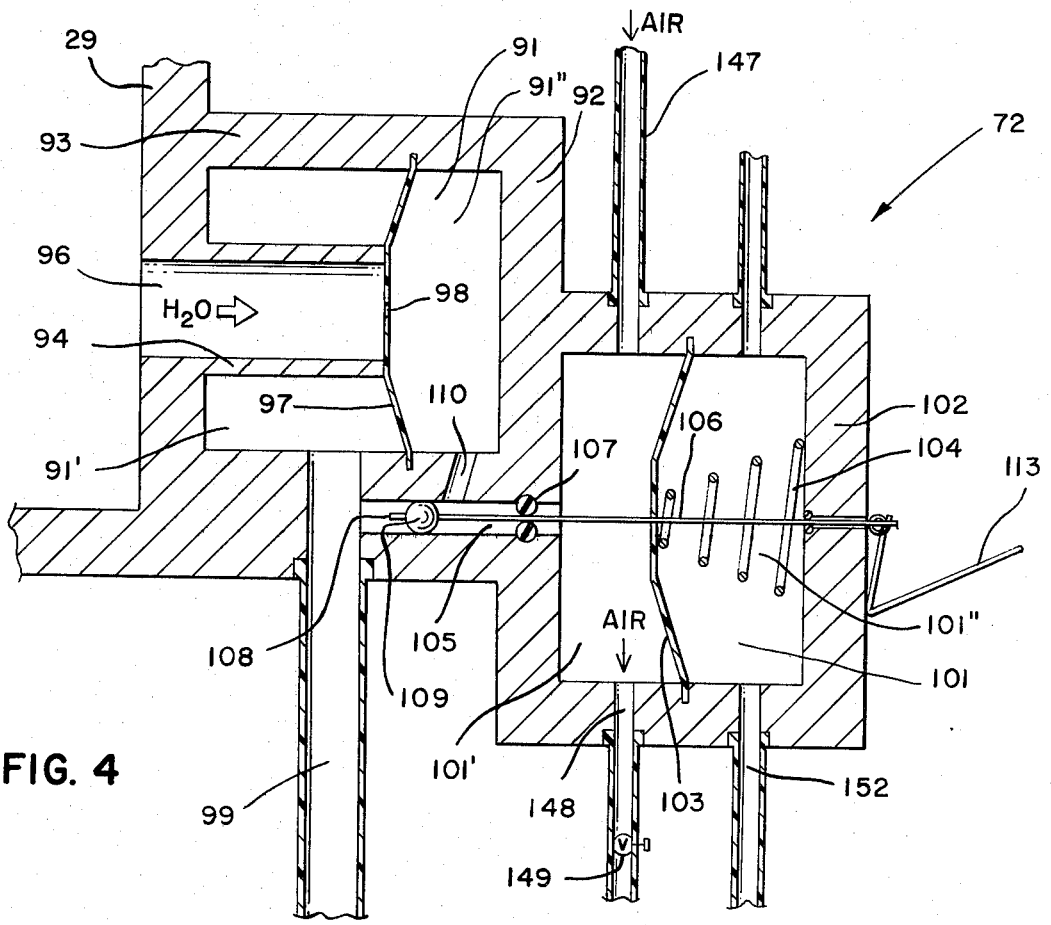
FIG. 4 is a fragmentary cross-sectional schematic view in enlarged scale illustrating the structural and functional relationships embodied in the activating valve of the assembly.
Figure 5:
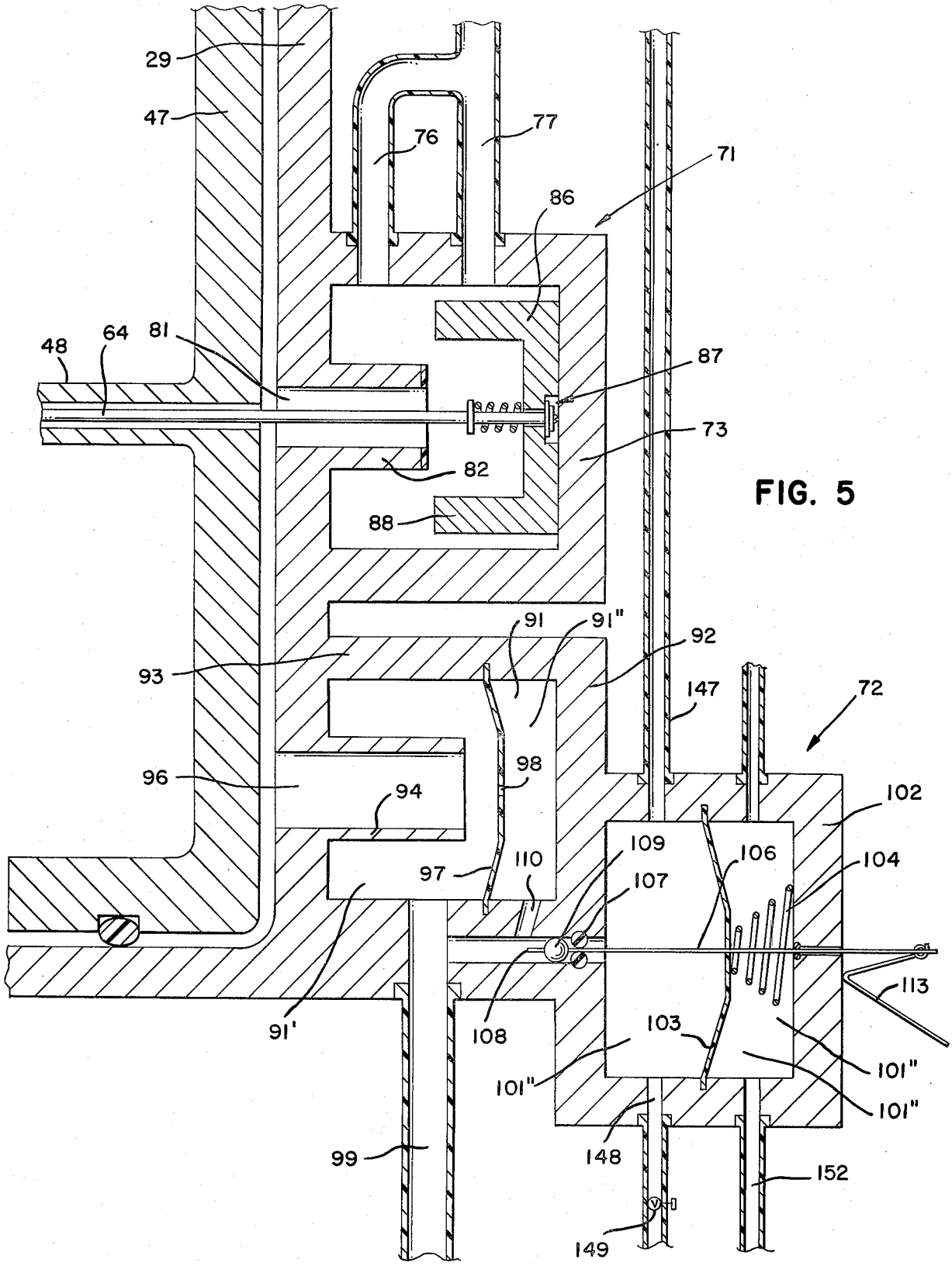
FIG. 5 is a fragmentary schematic cross-sectional view in enlarged scale illustrating the structural and functional relationships of both the regenerative valve assembly and the activating assembly.
Figure 8:
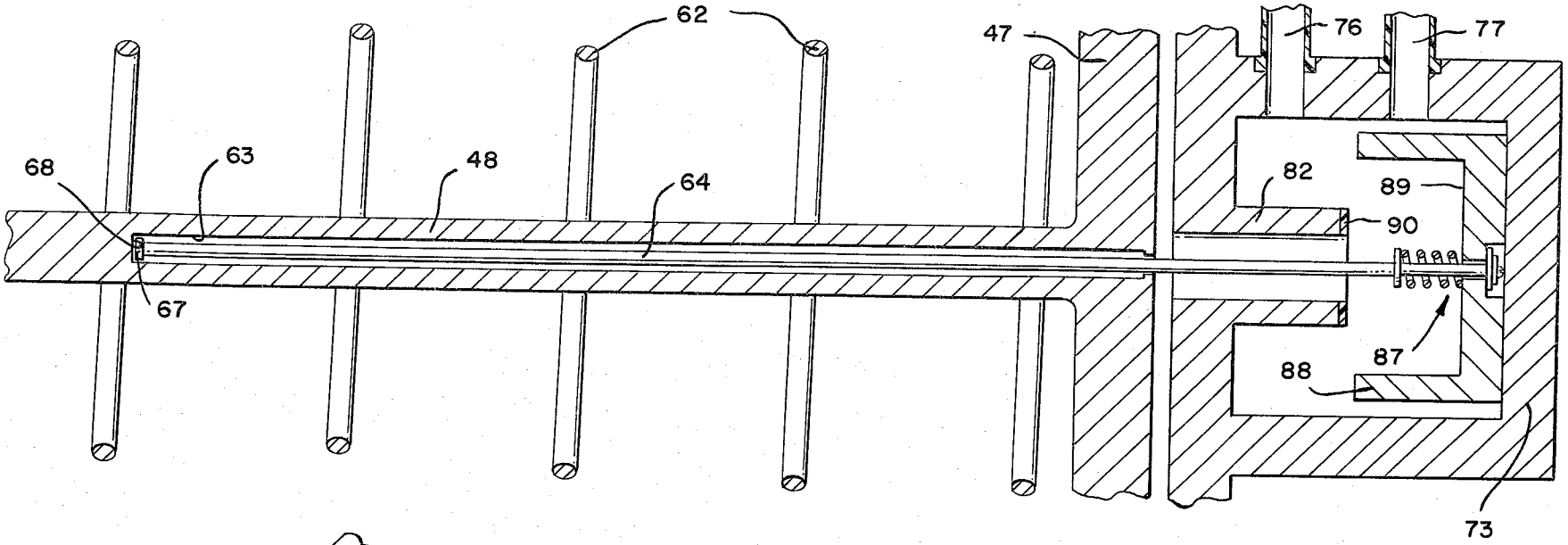
FIG. 8 is a fragmentary schematic cross-sectional view of the control rod and piston assembly, illustrating their structural and functional relationship.
Figure 10:
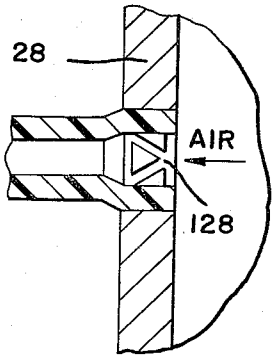
FIG. 10 is a fragmentary schematic cross-sectional view of one of the outlet check valves.
Figure 9:
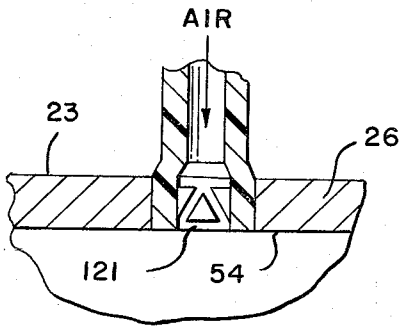
FIG. 9 is a fragmentary schematic cross-sectional view of one of the inlet check valves.

It will be noted that the piston 47, including skirt portion 59 defines a variable volume chamber 61 between piston 47, transverse wall 36 and cylindrical wall 27 when the piston 47 is in its extreme left position as illustrated in FIG. 1. Within the chamber there is provided a coil compression spring 62 adapted to react resiliently against the intermediate wall 36 on the left and resiliently against the piston 47 on the right in a manner and for a purpose which will hereinafter be explained. Additionally, it will be noted that shaft 48 is provided with a central bore 63 extending for a predetermined distance along the shaft and adapted to slidably receive therewithin a control rod 64 having one end portion 66 extending through a restricted aperture in the piston 47, and having a length such that when the piston 47 is moved to the opposite extreme position to the right as illustrated in FIG. 2, the enlarged free end 67 of the control rod enclosed in bore 63 "bottoms" or engages the bottom 68 of the bore 63 and from this point will move to the right with the piston 47 for purposes which will hereinafter be explained. The length of the control rod and the depth of the bore 63 are such that the control rod commences its movement to the right just prior to the piston 47 reaching its extreme right position as shown in FIG. 2. In the opposite direction, the enlarged end of the rod engages the restriction in the piston aperture and the valve member 86 is pulled into closed position.

The housing assembly 21 is provided with a regenerating valve assembly designated generally by the numeral 71 and an activating valve assembly designated generally by the numeral 72. Referring to FIG. 1, it will be seen that the regenerating valve assembly preferably forms an integral part of the end wall 29 of the separable section 24 and includes a housing projection 73 defining a chamber 74 therewithin into which is connected a source of water by inlet pipes or passageways 76 and 77, each connected in turn to a conduit 78 common to both. An appropriate valve 79 may be interposed in the water inlet conduit 78 as illustrated.

Formed in end wall 29 along the longitudinal central axis 31 is an opening or passageway 81 defined in part by a cylindrical projection 82 that extends into the interior of the major valve chamber 74. Disposed within the major valve chamber 74 is a cup-shaped major valve member 86 adapted to move axially within the major valve chamber. The major valve member is connected to the control rod 64 by a minor valve assembly 87. The open end of the cylindrical projection 82 is coaxially arranged with the flange portion 88 of the major valve member 86 so that the open end edge of the cylindrical projection 82 selectively sealingly abuts against the inner side or surface 89 of the major valve member. An appropriate seal member or seat 90 may be provided on the end edge of cylindrical extension 82, to be engaged by the flat inner surface 89 of the major valve member 86, to thereby prevent water flow between the chamber 74 and the passage 81, or vice versa.

It should be noted that the inlet passageways 76 and 77 are spaced apart a distance having a correlation to the length of the flange 88 of major valve member 86. Thus, when the major valve member is in closed position as illustrated in FIG. 1, the flange 88 opposes the inlet of passageway 76, while exposing the inlet of passageway 77 with chamber 74. In this relationship of the parts no water will flow from the water source through the passageway 81 and into the chamber 43. However, when the major valve member 86 is shifted to the right into the position illustrated in FIG. 2, it will be seen that the inlet of passageway 76 is now exposed and water may flow from chamber 74 through passageway 81 and into chamber 43. The manner and purpose of operation of this regenerating valve assembly will be explained in greater detail after remaining structure has been described.

Also associated with the end wall 29, and preferably forming an integral part thereof, is the activating valve assembly 72. As illustrated in FIG. 1, the activating valve assembly includes a first diaphragm chamber 91 formed by a projecting housing portion 92 having a hollow interior defined by generally cylindricall walls 93. Projecting into the diaphragm chamber 91 is a tubular projection 94 defining a passageway 96 between chamber 43 and the interior of diaphragm chamber 91. Mounted within diaphragm chamber 91 is a diaphragm 97 having its outer peripheral edges appropriately sealed to the inner periphery of the cylindrical wall 93, and having its central portion adapted to sealingly overlie the open end of the tubular projection 94.

The diaphragm 97 constitutes a valve member and is provided with a small central aperture 98 for a purpose which will hereinafter be explained. It will thus be seen that the diaphragm divides the diaphragm chamber 91 into two separate sub-chambers 91' and 91''. The sub-chamber 91' is connected by a passageway 99, preferably a conduit, to the interior of the toilet bowl 3. It should be noted that the passageway or conduit 99, while communicating with the sub-chamber 91', is controlled in so far as the passage of water therethrough is concerned by the position of the diaphragm 97. Thus, when the diaphragm is in the position illustrated in FIG. 1, there is no water flow through passageway 99. Conversely, when the diaphragm 97 is moved or displaced to the right into sub-chamber 91'', sub-chamber 91' is connected with passageway 96 and the interior of the separable section 24. Fluid within chamber 43 may thus flow through the passageway 96 into sub-chamber 91' and therefrom into discharge passageway 99 connecting with the toilet bowl 3.

Control of the movement of the diaphragm 97 is partially effected by a control chamber 101 forming an integral part of the activating valve and defined by a housing extension 102 associated adjacent to or forming an integral part of the housing extension 92. The control chamber 101 is generally cylindrical in configuration and is provided intermediate its ends with a diaphragm 103, the outer peripheral edge of which is appropriately sealed in any suitable manner to the cylindrical side wall of the housing extension 102 at about its midpoint. The chamber 101 is thus divided into two sub-chambers 101' and 101'' on opposite sides of the diaphragm, and a spring 104 is provided in sub-chamber 101'' acting to bias the diaphragm into sub-chamber 104'. Additionally, the control chamber 101 is provided with a passageway 105 that extends between the sub-chamber 101' and the passageway 99 communicating sub-chamber 91' with a toilet bowl.

Mounted on the diaphragm 103 is an elongated rod 106 one end of which passes through sub-chamber 101' and the passageway 105, and being provided with an appropriate "O" ring seal 107 about the rod as shown. Adjacent its end 108 the rod 106 is provided with an "O" ring 109 that moves with the rod in relation to a port 110 formed in the wall of passageway 105 and communicating between sub-chamber 91'' and passageway 105. Additionally, the rod 106 passes through the sub-chamber 101'' and extends sealingly and slidably through the housing extension 102 to be provided on the exterior thereof with an actuating assembly including lever 113 which operates in a manner and for a purpose which will hereinafter be explained.

The pressure exchanger as the assembly 21 may be called, cooperates with the regenerating valve and activating valve to channel water into the toilet bowl. At the appropriate time, the assembly is activated to open the evacuation chamber gate 6, permitting water and waste materials to be deposited in the evacuation chamber and then to close the evacuation chamber gate. As soon as the gate is closed, the system pumps high pressure air into the evacuation chamber to force the water and waste products through the U-shaped trap 13 and into the sewerage system.

To effect this operation, pressure exchanger assembly 21, and more specifically, the separable sections 23 and 24 thereof, are appropriately interconnected by means of conduits with the activating valve and with the evacuation chamber and chamber gate mechanism to effectuate this purpose. Structurally, referring to FIG. 1 and specifically section 23 thereof, it will be seen that an air inlet port 121 is provided in the wall 26, the air inlet port having an appropriate valve structure therein such as a check valve that operates automatically to permit air to enter the chamber 38 but prevents its escape. The inlet port is spaced a short distance from end wall 28.

The inlet port 121 is connected by a conduit 122 to the air inlet port 123 formed in the cylindrical wall 27 of chamber 43 closely adjacent the intermediate wall 36. Additionally, the conduit 122 may have interposed therein an air filter mechanism 124, however, it has been found that such an air filter is a convenient adjunct but is not essential to the operation of the device. In any event, conduit 122 continues beyond such filter and is connected to the air inlet port 126 formed in the cylindrical wall 26 of chamber 38 at a point next adjacent the intermediate wall 36, as shown. In this regard, it should be noted that the air inlet port 123 is positioned in the cylindrical wall 27 next adjacent the intermediate wall 36 but on the opposite side thereof from the port 126.

Formed in the end wall 28 of the separable cup-shaped section 23 of the housing are ports 127 and 128. These ports are likewise equipped with a valve mechanism such as a check valve. The port 127 permits admission of fluid into the chamber 38 and more specifically into the variable volume chamber formed between wall 28 and piston 46. The valve mechanism in port 128 is arranged to permit the egress of fluid under pressure therethrough as when piston 46 moves to the left as viewed in FIG. 1. Valve port 127 is connected by an appropriate conduit 129 to an automatically operating "retrograde" check valve assembly designated generally by the numeral 131. Valve port 128 is connected by an appropriate conduit 132 to conduit 133 one end of which terminates in outlet port 134 formed in the cylindrical wall 27 of chamber 43 while the other end of conduit 133 communicates with the evacuation chamber. The outlet port 134 is also equipped with an automatic check valve as illustrated schematically that permits egress of fluid from the chamber 43 but prevents admission of fluid thereto. In terms of physical location in the embodiment illustrated, the outlet valve port 134 is located next adjacent the intermediate wall 36 as shown. The end of the conduit 133 opposite the valved port 134 communicates with the interior of the evacuation chamber and it is through this conduit that air under pressure is conveyed so as to pressurize the evacuation chamber and force evacuation of waste products into the sewerage system.

To operate the evacuation chamber gate, the conduit 122, in addition to being connected to the inlet port 126, is connected by a lateral conduit 135 to the retrograde automatic check valve assembly 131. This valve assembly is also connected by means of conduit 136 to the vacuum cylinder 12 and serves to convey air to and from that cylinder to effect opening and closing of the evacuation chamber gate. Structurally, the retrograde automatic check valve comprises a housing 137 having a hollow interior 138 into which extend the free ends of both conduits 129 and 135. The relationship of the free ends of these conduits is such that the conduit 135 extends beyond the inner expanded diameter end of conduit 129, and is opened or closed for the passage of air into or from the chamber 138 by manipulation of a valve designated generally by the numeral 139.

Figure 6:
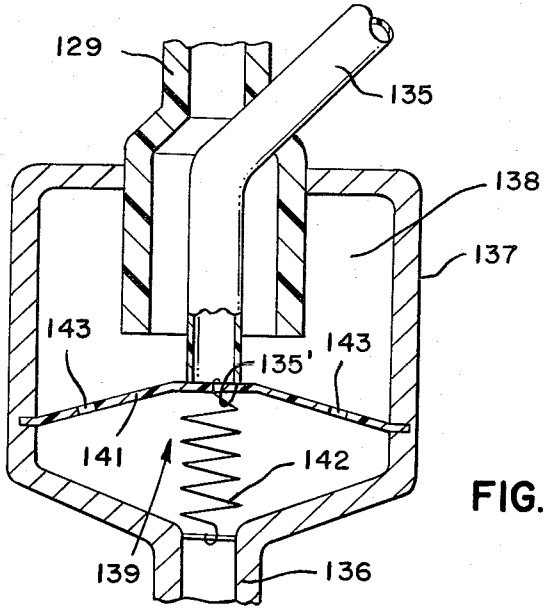
FIG. 6 is a fragmentary schematic cross-sectional view of the retrograde automatic check valve assembly that functions to control operation of the air cylinder that opens and closes the evacuation chamber gate.
Figure 7:
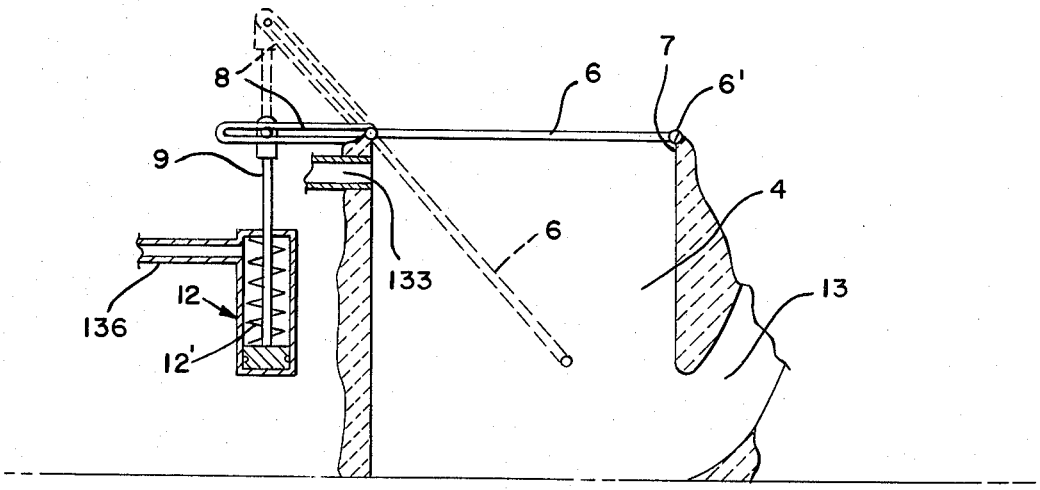
FIG. 7 is a fragmentary schematic view, partly in cross-section of the evacuation chamber and gate and operating air cylinder therefor.

The valve is shown schematically in FIG. 6, and includes a diaphragm 141 contained within the chamber 138 and having its peripheral edges sealed to the interior walls of the chamber in any convenient manner. The diaphragm is provided with a spring 142 that retains the diaphragm in a normally valve-open position, i.e., the diaphragm spaced from the free end of conduit 135. The diaphragm is sucked into a valve-closed position by vacuum pressure imposed through conduit 129.

When this occurs, the diaphragm 141 moves into contact with the open end 135' of conduit 135, thus closing off this conduit to the passage of atmospheric air. Preferably, the diaphragm 141 is provided with a series of apertures 143 arranged in a circular array to permit the passage of air therethrough. The apertures 143 are sufficiently small that they form a restriction while permitting fluid to pass, and do not prevent actuation of the diaphragm 141 when a vacuum pressure is pulled on conduit 129 by movement of piston 46 to the right as viewed in FIG. 1. The vacuum pressure thus exerted is not relieved by atmospheric pressure air admitted through conduit 135 since its open end is sealed off by the diaphragm. The result is that the vacuum pressure imposed on the piston of vacuum cylinder 12, thus compressing the spring 12' associated therewith, and causing the evacuation chamber gate to open. This negative or vacuum pressure is imposed, in point of time, until the piston 46 passes the valve port 121, at which time the vacuum is broken and the spring 12' closes the evacuation chamber gate.

Also provided in the cylindrical wall 26 next adjacent the intermediate wall 36 is an outlet port 146 connected by an appropriate conduit 147 to the sub-chamber 101' of the activating valve 72. This sub-chamber 101' is also provided with an outlet port 148 equipped with an appropriate valve 149 for purposes which will hereinafter be explained. Additionally, the sub-chamber 101'' on the opposite side of the diaphragm from the inlet port of conduit 147 and the outlet port 148 is provided with ports 151 and 152 which cooperate with the diaphragm to effectively control actuation of the activating valve in a manner which will hereinafter be explained.

Thus, as the piston 46 moves to the right, since inlet ports 121 and 126 are closed by the build-up of pressure in chamber 38, and since this chamber has previously been filled with air under atmospheric pressure, this pressurized air is now forced to egress through outlet port 146 and conduit 147, with the result that sub-chamber 101' to which the conduit 147 is connected, is pressurized, causing the diaphragm 103 to be held to the right as viewed in FIG. 1, thus retaining passageway 105 open, which in turn results in diaphragm 97 being retained to the right, thus permitting water from chamber 43 to be discharged through chamber 108 and conduit 99 into the toilet bowl under the impetus of piston 47 reacting to pressure exerted by spring 62.

During this interval, the cup-shaped major valve 86 is in a closed condition and is held closed by water pressure from the source. It is held closed until the piston approaches the end of its movement to the right, at which time the free end 67 of the control rod is engaged by the bottom of the central bore 63 of shaft 48. Continued movement of piston 47 then causes the major valve 86 to open and the cycle is repeated.

When the control valve assembly is first assembled, and prior to being activated or having water admitted to it for purposes of actuation, the arrangement of the parts will be as illustrated in FIG. 2. As there shown, the coil spring 62 is in its expanded position causing the pistons 46 and 47 to be positioned at their extreme right as illustrated in FIG. 2. In this position, it will be noted that piston 46 lies closely adjacent the intermediate wall 36, while the piston 47 lies closely adjacent the end wall 29. The chambers 38 and 43 may each thus be thought of as being comprised of two separate variable volume chambers divided by the respective pistons. One such chamber forming a part of separable section 24 may be designated A and is illustrated to the right of piston 47 as viewed in FIGS. 1 and 2. Chamber B, also forming a part of separable section 24, may be considered to be the space illustrated in FIGS. 1 and 2 between piston 47 and intermediate wall 36. Spring 62 is contained within this chamber.

With respect to separable section 23 and piston 46, the chamber illustrated to the right of piston 46 in FIGS. 1 and 2 is designated Chamber C, while the space between the piston 46 and the end wall 28 may be considered to be Chamber D. Thus, Chamber A is connected by valved passageways 81 and 96, respectively, with the regenerating valve assembly and the activating valve assembly, specifically chamber 91 thereof. Chamber B on the other hand communicates through conduit 122 and ports 121 and 126 with Chamber C, while Chamber D communicates through ports 127 and 128 and conduits 129 and 132, respectively, with the retrograde automatic check valve 131 and Chamber B and the evacuation chamber 4. It should be noted that as Chamber C diminishes and Chamber D increases in volume by movement of piston 46 to the right, the port 121 shifts from communication with Chamber C to communication with Chamber D.

From the position of the parts as illustrated in FIG. 2, when the valve 79 is opened to admit water through conduit 78 to the regenerating valve assembly 71, water will pass through passageway 76 into the interior of chamber 74 and will flow from chamber 74 through passageway 81 into Chamber A, i.e., into the reduced-in-volume space between piston 47 and end wall 29. Water pressure will retain the major valve member 86 in an open position and will simultaneously exert pressure against piston 47, moving this piston to the left as viewed in FIG. 2 until it reaches the position illustrated in FIG. 1.

Movement of the piston 47 to the left causes an increase in the tension of spring 62 of about eighty to one hundred pounds per inch of compression of the spring. It has been found that spring 62 may conveniently have a "free standing" length of approximately twelve inches and be compressible to less than three inches in compressed height. Thus, if it is considered that in the expanded condition of the spring as illustrated in FIG. 2 it has been compressed six inches from its free standing dimension, it will be seen that in this condition of the parts there is from about 480 pounds to 600 pounds of total pressure exerted on the piston by the spring. Since water pressures frequently exceeds fifty pounds per square inch, and since the piston possesses approximately 32 square inches of effective area, there is more than enough water pressure working on the face of the piston to compress the spring 62.

As the piston 47 is forced to the left by the admission of water into Chamber A, it will be seen that Chamber A increases in volume while Chamber B decreases in volume. As Chamber B decreases in volume, the air contained therein is compressed and pressurized. In like manner, because of the interconnection of piston 46 with piston 47 by shaft 48, piston 46 moves to the left, thus increasing the volume of Chamber C and decreasing the volume of Chamber D. Air contained in Chamber D is likewise compressed and pressurized and this compressed air, together with compressed air from Chamber B, is used to pressurize the evacuation chamber. In FIG. 2, it will be seen that Chamber D at this stage of operation is much larger in its volume than Chamber C and that there is only one outlet port in Chamber D, this being outlet port 128 which directs air compressed by piston 46 to the evacuation chamber 4. Thus, since Chamber B is also connected through outlet port 134 and conduit 133 to the evacuation chamber, as pistons 46 and 47 move to the left under the action of water from the domestic water source, the air contained in Chambers B and D to the left of pistons 46 and 47 is compressed and forced to pass through outlet ports 128 and 134 and is delivered to the evacuation chamber. Since the volume of Chambers B and D and the volume of air discharged therefrom is considerable, air discharged into the evacuation chamber forces water and waste materials therein through the U-trap 13 and into the sewerage system.

Means are provided for selectively initiating actuation of the mechanism so that the flushing operation occurs upon demand. To effect cycling of the control valve 21, and reciprocation of the pistons 46 and 47, the control rod 64 cooperates with the piston 47 to pull the seal member 86 into a closed position as illustrated in FIG. 1. This effectively stops water from entering Chamber A through conduit 78. It should be understood that during the filling of Chamber A, a limited amount of water passes through port 96 in the activating valve assembly and passes through narrow port 98 formed in diaphragm 97. This causes sub-chamber 91'' to fill with pressurized source water, after which no further flow occurs through narrow port 98.

Since the effective area of the diaphragm 97 against which the water in sub-chamber 91'' works is considerably greater than the effective area of water in inlet 96, the diaphragm 97 is pressed into sealing relationship with the end of tubular member 94. This prevents water from flowing into sub-chamber 91' and from there into outlet conduit 99. Water trapped behind the diaphragm 97 also fills passageway 110 connecting sub-chamber 91'' with passageway 105 and also fills the latter. However, water filling passageways 110 and 105 is not initially permitted to discharge into the outlet conduit 99 because of the "O" ring valve 109 mounted on the rod 106, the "O" ring being disposed in the passageway between the discharge end of the passageway 110 and the outlet port into conduit 99. Water is prevented from passing in the opposite direction along passageway 105 by "O" ring 107 suitably set into the passageway 105 walls and working in cooperation with the outer periphery of the rod 106 to form a water tight seal. This effectively keeps water from entering into the sub-chamber 101'.

Accordingly, as water admitted to Chamber A fills the sub-chamber 91'', the water pressure retains the diaphragm 97 in closed condition until such time as the toilet is flushed. As previously discussed, when pistons 46 and 47 move to the left, air within Chambers B and D is compressed and forced to exit under pressure through outlet ports 128 and 134. Since port 123 in separable section 24 constitutes a check valve, it prevents the escape of air through this port as piston 47 moves to the left. In the same manner, ports 121 and 127 in separable section 23 prevent the passage of air therethrough as piston 46 moves to the left under the impetus of water being admitted into Chamber A. However, port 126 permits the entry of air into the expanding Chamber C as piston 46 moves to the left, thus maintaining atmospheric pressure between the piston 46 and the intermediate wall 36.

Since port 146 in separable section 23 constitutes a check valve and permits air to flow from Chamber C through conduit 147 to the interior of sub-chamber 101' of the activating valve 72. Additionally, it should be noted that while port 121 is a check valve that normally prevents air from exiting through this port as piston 46 moves to the left, as soon as the piston 46 has passed this port, the valve opens and permits air under atmospheric pressure to enter into the Chamber C. The position of the parts as illustrated in FIG. 1 is the normal at-rest position of the assembly at the beginning and end of each cycle. The position of the parts as shown in FIG. 2 is the position of the assembly at the end of the first one-half cycle after the toilet has been flushed.

The control valve is retained in the attitude of FIG. 1 until an initiating action is taken to flush waste materials from the toilet. To flush waste products from the fixture, all that is required is that flush lever 113 forming a part of the activating valve 72 be actuated to cause the "O" ring valve 109 associated with valve rod 106 to move to the right in the passageway 105, thus permitting water to escape from the sub-chamber 91'' through the passageway 105 and the outlet conduit 99. As soon as this occurs, the pressure of the water in the sub-chamber 91'' is reduced, permitting the diaphragm 97 to move to the right, thus opening passageway 96 and permitting water from Chamber A to pass at high pressure and with considerable velocity through sub-chamber 91' and the outlet conduit 99 and into the toilet bowl.

When flush lever 113 is actuated, diaphragm 103 is moved to the right into sub-chamber 101'' against spring pressure that tends to hold it in the position shown in FIG. 1. To maintain the diaphragm in this retracted position, air from Chamber C under the impetus of the spring-returned piston 146 is forced through outlet port 46 and conduit 147 and delivered to sub-chamber 101', thus retaining the diaphragm 103 to the right and the passageway 105 in open position until all of the water has been expelled from Chamber A under the impetus of the spring 62. When the piston 47 approaches its limit of travel under the impetus of spring 62, the bottom 68 of the bore 63 comes in contact with the free end 67 of control rod 64, thus opening the minor valve 87 for a time to equalize the pressure on both sides of the main valve 88. Continued travel of the piston 47 to the right effects opening of the main valve 88 to again commence the charging or filling portion of the cycle by admitting water under pressure from the water source to Chamber A.

To operate the evacuation chamber gate, and thus deposit waste products and water collected in the bottom of the toilet bowl into the evacuation chamber 4, movement of the piston 46 to the right as viewed in FIG. 1 causes a vacuum or negative pressure to be formed in Chamber D, the vacuum being effective through conduit 129 to impose a vacuum pressure on the spring-loaded vacuum cylinder 12, compressing the spring to thus open the evacuation chamber gate to permit waste products and water to pass through the opening in the base of the toilet into the evacuation chamber.

The evacuation chamber gate is open only momentarily, the length of time being determined by the interval that it takes the piston 46 to travel from its extreme left position as illustrated in FIG. 1 to a point just past the inlet port 121. When the piston passes the port 121, since this port includes a check valve that permits entry of air, the vacuum formed behind the piston 46 will be broken by the entry of atmospheric air into the expanding Chamber D. As soon as the vacuum is broken, the vacuum pressure in vacuum cylinder 12 is replaced by atmospheric pressure admitted through conduit 135 and the spring in the vacuum cylinder effects closing of the evacuation chamber gate.

Where desirable, the sub-chambers 101' and 101" may be utilized for dispersing disinfectant or deodorizing materials into the toilet facility. For instance, the sub-chamber 101' is provided with an outlet passageway or port 148 controlled by a suitable valve 149, which may be a check valve. When air under pressure is forced into the sub-chamber 101' through conduit 147, it may be permitted to exit that chamber through the passageway 148 which may then connect through an appropriate conduit to a utilization device such as an air flow regulator or other appropriate dispensing device for deodorants or disinfectants.

When movement of the pistons 46 and 47 to the right has terminated, it should be understood that port 126 relieves the pressure in now minimum volume Chamber C. Also, the pressure in sub-chamber 101' of activating valve 72 drops to atmospheric pressure, thus permitting the diaphragm 103 under the impetus of a spring 104' to move to the left as viewed in FIG. 1, thus carrying the microvalve 109 past the port 110, thus again sealing the chamber 91" so that water admitted into the Chamber A will again pass through the port 98 to hold the diaphragm 97 in closed position.

A prototype of the structure described above utilizes approximately one gallon of water and automatically completes a full cycle in under ten (10) seconds once the flush lever 113 is actuated. No additional air besides the air compressed in Chamber B and D is necessary to effect complete discharge of waste products and water from the evacuation chamber 4, and it has also been found that the control valve is modular in that separable section 23 may be increased in size in comparison to separable section 24 to thus increase the volume of air discharged from Chamber D. The control valve additionally has so much versatility that it permits connecting one or more such valves in tandem to further increase the volume of air if that is necessary or desirable.

Figure 12:
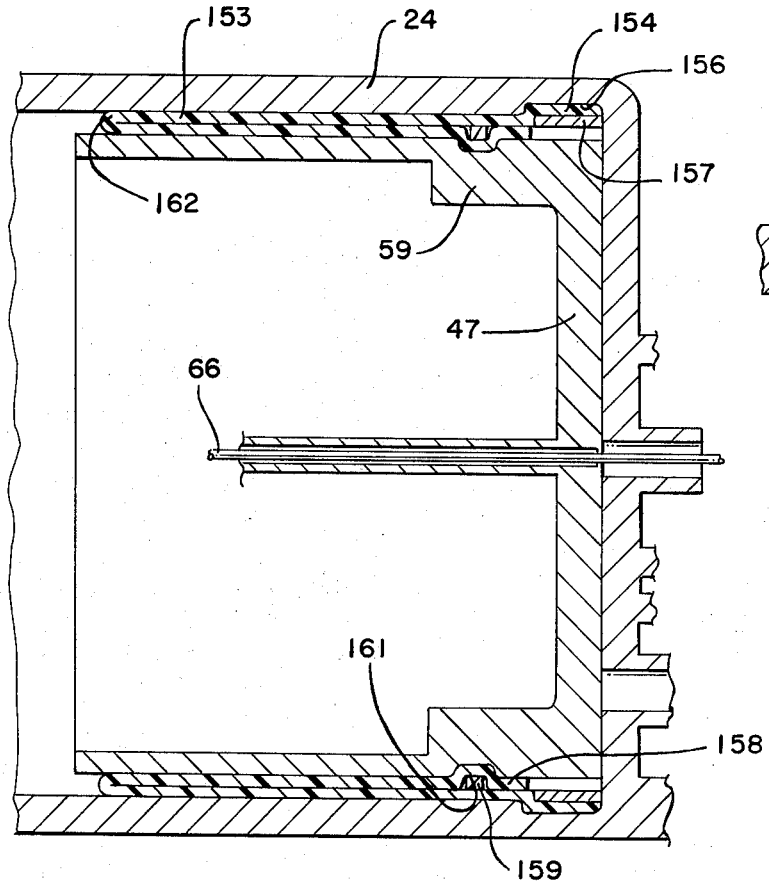
FIG. 12 is a fragmentary schematic cross-sectional view of a second embodiment of the main piston assembly, embodying a flexible boot as a sealing member.
Figure 11:
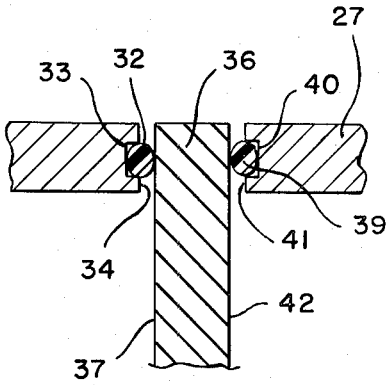
FIG. 11 is a n enlarged fragmentary cross-sectional view taken in the plane indicated by the line 11—11 in FIG. 2.

It should be understood that various improvements and modifications may be made without departing from the spirit of the invention as defined by the appended claims. For instance, in FIG. 12, in lieu of an "O" ring seal on piston 47, a flexible boot 153 may be provided. In this construction, one end portion 154 of the boot is secured in a water tight manner to the inner periphery of the separable section 24. To accomplish this attachment, an annular groove 156 is provided into which the end portion 154 is seated by a split spring ring 157. The other end portion 158 of the elongated cylindrical boot is sealed about the piston in like manner by a split spring ring 159 that seals the end portion 158 into an appropriate groove 161. It will thus be seen that axial translation of the piston results in unfolding of the boot at 162 where it is doubled back upon itself. One advantage of this construction is that the inner peripheral surface of the separable section 24 need not be machined and honed to a polished surface as is required for effective sealing by an "O" ring. Other advantages will be readily apparent.

In connection with the regenerating and activating valve assemblies, these assemblies in final production will probably be die cast or injection molded as a single housing unit, with the diaphragms and control rods being assembled on the housing unit after its fabrication.

Figure 13:
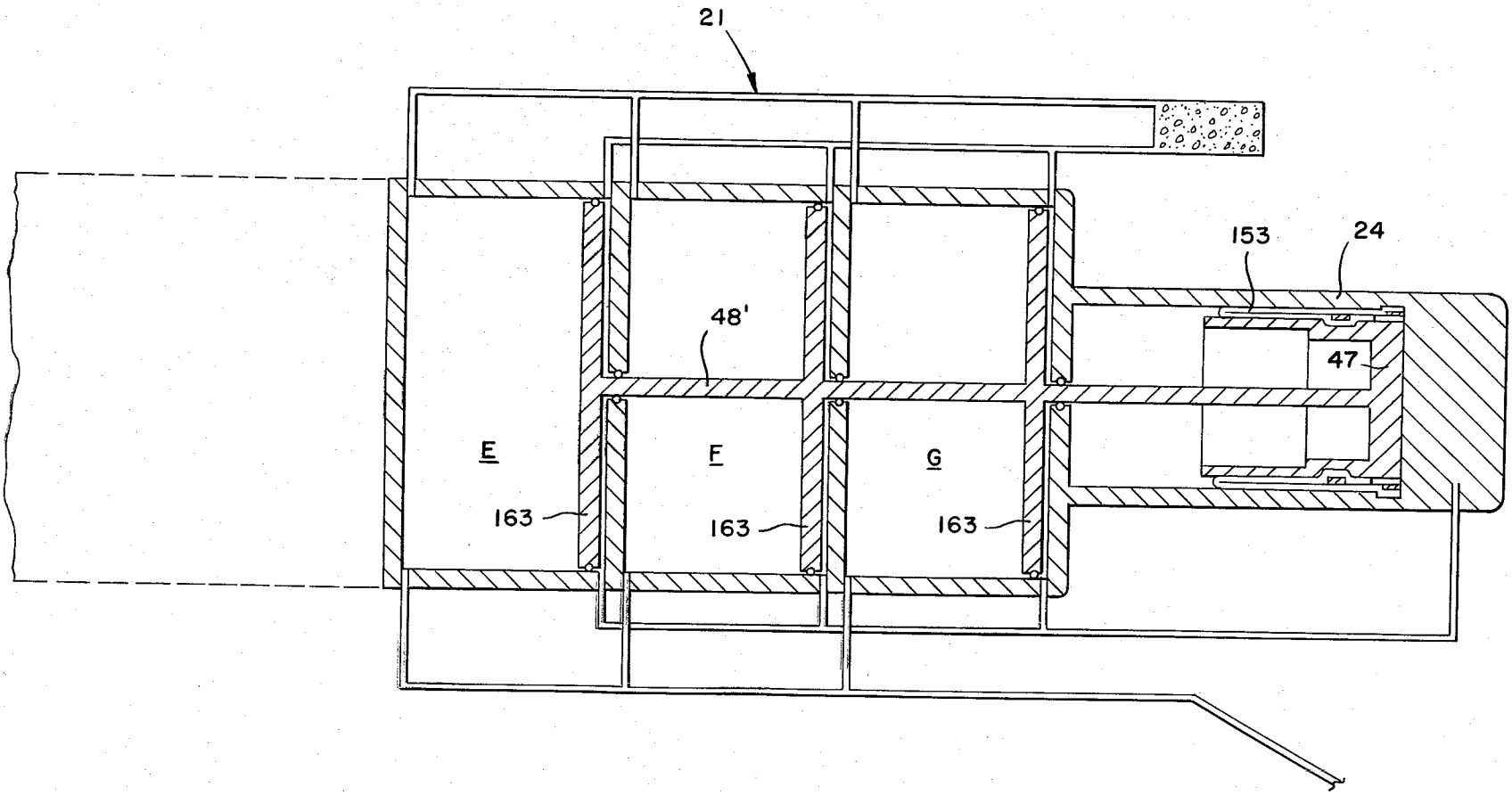
FIG. 13 is a schematic view of the control valve modified to incorporate four pistons connected in tandem to increase the amount of air pumped into the evacuation chamber.

Many other modifications can and will be made to facilitate high volume mass production of the system. It is intended that all such modifications be included within the scope of the appended claims. As an example of one such modification, FIG. 13 illustrates in schematic form an embodiment in which the pressure exchanger is formed from a multipart housing with the parts sealed as before and including three air chambers E, F and G, each provided with a piston 163 therein, all of the pistons 163 being interconnected by the shaft 48', which functions in the same manner as shaft 48 in FIGS. 1 and 2. The valving in each chamber is such that movement of the pistons to the left as viewed in FIG. 13 causes a build-up of air pressure, causing air to be discharged under pressure to the evacuation chamber through appropriate conduits connected with each chamber and connected in common with the evacuation chamber.

Having thus described the invention, what is believed to be new and novel and sought to be covered by Letters Patent of the United States is as follows:

I claim:

1. An apparatus for compressing a predetermined volume of air without the use of an independent motor-driven air compressor and for delivering said compressed air under pressure to the evacuation chamber of a pneumatic assisted water flush toilet bowl to discharge waste products from the evacuation chamber, comprising:

(a) a fluid-tight housing having walls defining a hollow interior;

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling admission of water under pressure to the other chamber of the pair to effect displacement of the piston to reduce the volume of the first mentioned chamber of the pair to pressurize the air therewithin above said predetermined pressure; and (d) means controlling delivery to said evacuation chamber of pressurized air from said other chamber of the pair to thereby effect discharge of waste products from said evacuation chamber.

2. The combination according to claim 1, in which said means controlling admission of water under pressure includes a valve assembly open while water under pressure is being admitted to said one chamber and closed by displacement of said piston when said one chamber is filled with water.

3. The combination according to claim 1, in which said piston is desplaceable in one direction by the admission of water under pressure to said one chamber and displaceable in the opposite direction by compressible means within said other chamber, said piston being displaceable in opposite directions between predetermined limits of movement, said means controlling admission of water under pressure to said one chamber including a valve assembly actuated to close the valve assembly when said one chamber is filled with water and actuated to open said valve assembly when said one chamber is empty of water.

4. The combination according to claim 1, in which means are provided including an activating valve assembly selectively operable to initiate flushing action of the apparatus, said means comprising a valve assembly, a water outlet passageway controlled by said valve assembly, and means operatively associated with said valve assembly controlling actuation thereof to release water under pressure from said one chamber.

5. In combination:

A. a water flush toilet bowl having (1) a base portion divided into a waste product collection recess and a waste product evacuation chamber and including an opening providing communication between said waste product collection recess and said waste product evacuation chamber, (2) an evacuation gate normally sealingly covering said opening and selectively operable to uncover said opening whereby waste product collected in said collection recess passes through said opening past said gate and into said evacuation chamber, (3) means operatively asssociated with said evacuation gate to normally retain the gate sealingly covering said opening and selectively operable to open said evacuation gate to uncover said opening; and B. means operatively associated with said toilet bowl to flush waste products therefrom and including:

(1) means including a housing having a movable wall defining chambers for segregating predetermined quantities of air and water from separate sources thereof, (2) means for delivering a portion of said segregated predetermined quantity of water to said waste product collection recess, (3) means for opening said evacuation gate for a predetermined interval to permit transfer from said collection recess of said portion of water and any waste product into said evacuation chamber, (4) means for closing said evacuation gate following said predetermined interval, (5) means for delivering the remaining portion of said segregated predetermined quantity of water to said waste product collection recess after closing of said gate, and (6) means for thereafter delivering said predetermined quantity of air under pressure to said evacuation chamber to discharge the water and waste products therefrom.

6. The combination according to claim 5, in which said evacuation chamber comprises a walled enclosure having said opening in one wall thereof, and a waste product discharge passageway through one of the other walls.

7. The combination according to claim 5, in which said evacuation chamber comprises a walled enclosure forming an integral part of said toilet bowl.

8. The combination according to claim 5, in which said collection recess forms an integral part of said toilet bowl.

9. The combination according to claim 5, in which said evacuation gate when open is in position to be flushed clean by water passing through said opening.

10. The combination according to claim 5, in which said means operatively associated with said evacuation gate to normally retain the gate sealingly covering said opening includes a vacuum cylinder having a piston therein and a shaft connected between said piston and said evacuation gate and operable by vacuum pressure to open said evacuation gate, a spring acting to resiliently retain said evacuation gate sealingly closed, and port means in said cylinder to selectively connect the interior thereof to a source of vacuum pressure to actuate said piston to open said evacuation gate.

11. The combination according to claim 5, in which said evacuation gate when closed is in position to be sealed more tightly by air under pressure admitted to said evacuation chamber.

12. The method of flushing waste products from a toilet bowl having a base portion divided into a waste product collection recess and a waste product evacuation chamber and including an opening providing communication between said waste product collection recess and said waste product evacuation chamber and an evacuation gate normally covering said opening, comprising the steps of:

(a) simultaneously segregating from separate sources thereof predetermined quantities of water and air in a housing having a movable wall defining separate water and air chambers;

(b) delivering said segregated predetermined quantity of water to the waste product collection recess of the toilet bowl over a predetermined water delivery interval;

(c) during said predetermined water delivery interval opening said normally closed evacuation gate to flush waste products from said collection recess into said evacuation chamber;

(d) thereafter closing said evacuation gate; and then (e) delivering said segregated predetermined quantity of air under pressure to said evacuation chamber while simultaneously segregating from said separate sources thereof another predetermined quantities of water and air.

13. The method of claim 12, in which said toilet bowl is equipped with a housing having a hollow interior divided into a water receiving chamber for receiving and segregating said predetermined quantity of water, and an air compression chamber within which air is pressurized and from which it is delivered to said evacuation chamber.

14. The method according to claim 13, in which said water receiving chamber is expanded in volume by water pressure and said air compression chamber is simultaneously contracted in volume.

15. The method according to claim 12, in which said evacuation gate is opened just after commencement of delivery of water to said collection recess.

16. The method according to claim 12, in which said evacuation gate is closed just prior to completion of delivery of said predetermined quantity of water to said collection recess.

17. The method according to claim 12, in which delivery of air to said evacuation chamber commences upon termination of delivery of water to said collection recess.

18. The method according to claim 12, in which delivery of air to said evacuation chamber terminates upon completion of segregation of another predetermined quantity from said source.

19. An apparatus for compressing and delivering air under pressure to the evacuation chamber of a pneumatic assisted water flush toilet bowl to discharge waste products from the evacuation chamber, comprising:

(a) a fluid-tight housing having walls defining a hollow interior:

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling admission of water under pressure to the other chamber of the pair to effect displacement of the piston to reduce the volume of the first mentioned chamber of the pair to pressurize the air therewithin above said predetermined pressure;

(d) means controlling delivery to said evacuation chamber of pressurized air from said other chamber of the pair to thereby effect discharge of waste products from said evacuation chamber; and (e) at least one additional pair of chambers within said housing, a piston separating the two chambers of the additional pair and constituting a displaceable wall movable to vary the volumes of said additional pair of chambers, means connecting said first mentioned piston with the piston separating said additional pair of chambers whereby said pistons move in unison, and means controlling the ingress and egress of air into and out of said additional pair of chambers in response to movement of said piston whereby movement of said piston in one direction pressurizes the air in at least one of said additional pair of chambers for delivery to said evacuation chamber.

20. The combination according to claim 19, in which said evacuation chamber is provided with a spring-pressed normally closed gate, means including a vacuum cylinder operative upon movement of said piston to increase the volume of said other chamber of the pair to open said normally closed gate, means selectively operable to release water under pressure from said one chamber and deliver such released water to said toilet bowl, means operative in conjunction with said vacuum cylinder to retain the evacuation chamber gate open a predetermined interval sufficient to permit flushing of all waste products from said toilet bowl into the evacuation chamber and subsequently closing said evacuation chamber gate prior to delivery of all the water from said one chamber whereby a portion of said water is delivered to said toilet bowl after all waste matter is flushed therefrom, said means controlling delivery of pressurized air to said evacuation chamber being activated upon completion of delivery of all water from said one chamber to said toilet bowl to thereby form a water seal over said evacuation chamber gate.

21. The combination according to claim 19, in which said housing is divided into two separate sections by an intervening wall, said piston is reciprocable within one section to divide that section into said pair of chambers variable in volume in response to displacement of said piston, and a second piston reciprocable in said other section and dividing said other section into an additional pair of chambers variable in volume in response to reciprocation of said second piston, means connecting said pistons whereby they move in unison, means including an activating valve assembly selectively operable to initiate flushing action of the apparatus, said means comprising a valve assembly, a water outlet passageway controlled by said valve assembly, and means operatively associated with said valve assembly controlling actuation thereof to release water under pressure from said one chamber, and means provided operatively associated with at least one of said additional chambers and communicating with said activating valve assembly to maintain said outlet passageway open until all water has been discharged therefrom.

22. An apparatus for compressing and delivering air under pressure to the evacuation chamber of a pneumatic assisted water flush toilet bowl to discharge waste products from the evacuation chamber, comprising:

(a) a fluid-tight housing having walls defining a hollow interior;

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling admission of water under pressure to the other chamber of the pair to effect displacement of the piston to reduce the volume of the first mentioned chamber of the pair to pressurize the air therewithin above said predetermined pressure;

(d) means controlling delivery to said evacuation chamber of pressurized air from said other chamber of the pair to thereby effect discharge of waste products from said evacuation chamber; and (e) said evacuation chamber being provided with a spring-pressed normally closed gate, and means including a vacuum cylinder operative upon movement of said piston to increase the volume of said other chamber of the pair to open said normally closed gate.

23. An apparatus for compressing and delivering air under pressure to the evacuation chamber of a pneumatic assisted water flush toilet bowl to discharge waste products from the evacuation chamber, comprising:

(a) a fluid-tight housing having walls defining a hollow interior;

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling admission of water under pressure to the other chamber of the pair to effect displacement of the piston to reduce the volume of the first mentioned chamber of the pair to pressurized the air therewithin above said predetermined pressure;

(d) means controlling delivery to said evacuation chamber of pressurized air from said other chamber of the pair to thereby effect discharge of waste products from said evacuation chamber; and (e) said housing being divided into two separate sections by an intervening wall, said piston is reciprocable within one section to divide that section into said pair of chambers variable in volume in response to displacement of said piston, and a second piston reciprocable in said other section and dividing said other section into an additional pair of chambers variable in volume in response to reciprocation of said second piston, and means connecting said pistons whereby they move in unison.

24. An apparatus for compressing and delivering air under pressure to the evacuation chamber of a pneumatic assisted water flush toilet bowl to discharge waste products from the evacuation chamber, comprising:

(a) a fluid-tight housing having walls defining a hollow interior;

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling admission of water under pressure to the other chamber of the pair to effect displacement of the piston to reduce the volume of the first mentioned chamber of the pair to pressurize the air therewithin above said predetermined pressure;

(d) means controlling delivery to said evacuation chamber of pressurized air from said other chamber of the pair to thereby effect discharge of waste products from said evacuation chamber; and (e) said means controlling admission of water under pressure to said one chamber comprises a regenerative valve assembly including an inlet passageway providing ingress of water to said one chamber, a valve member moveable to open or close said inlet passageway, and means disposed between said valve member and said piston operative to o pen said inlet passageway for the passage of water therethrough when the piston reaches the limit of its displacement in one direction and operative to close said inlet passageway to prevent passage of water therethrough when the piston reaches the limit of its displacement in the opposite direction.

25. In combination:

A. a water flush toilet bowl having (1) a base portion divided into a waste product collection recess and a waste product evacuation chamber and including an opening providing communication between said waste product collection recess and said waste product evacuation chamber, (2) an evacuation gate normally sealingly covering said opening and selectively operable to uncover said opening whereby waste product collected in said collection recess passes through said opening past said gate and into said evacuation chamber, (3) means operatively associated with said evacuation gate to normally retain the gate sealingly covering said opening and selectively operable to open said evacuation gate to uncover said opening; and B. means operatively associated with said toilet bowl to flush waste products therefrom by sequentially:

(1) segregating a predetermined quantity of water from a source thereof, (2) delivering a portion of said segregated predetermined quantity of water to said waste product collection recess, (3) opening said evacuation gate for a predetermined interval to permit transfer from said collection recess of said portion of water and any waste product into said evacuation chamber, (4) closing said evacuation gate following said predetermined interval, (5) delivering the remaining portion of said segregated predetermined quantity of water to said waste product collection recess after closing of said gate, and (6) thereafter delivering air under pressure to said evacuation chamber to discharge the water and waste products therefrom;

C. said means operatively associated with said toilet bowl to flush waste products therefrom including:

(a) a housing having walls defining a hollow interior;

(b) at least one piston reciprocable within said housing and constituting a displaceable wall defining with said housing walls a pair of chambers variable in volume in response to displacement of said piston, one of said chambers of said pair containing air at a predetermined pressure;

(c) means controlling segregation of said predetermined quantity of water in one chamber of the pair while effecting displacement of the piston to reduce the volume of the other chamber of the pair to pressurize the air therewithin above said predetermined pressure; and (d) means controlling delivery of said portion of said segregated predetermined quantity of water to said collection recess, opening and then closing said evacuation gate, delivering the remaining portion of said segregated predetermined quantity of water to said waste product collection recess, and thereafter delivering air under pressure to said evacuation chamber to discharge the water and waste products therefrom while simultaneously segregating another predetermined quantity of water in one chamber of said pair of chambers.

26. The combination according to claim 25, in which said housing is divided into two separate sections by an intervening wall, said piston is reciprocable within one section to divide that section into said pair of chambers variable in volume in response to displacement of said piston, and a second piston reciprocable in said other section and dividing said other section into an additional pair of chambers variable in volume in response to reciprocation of said second piston, and means connecting said pistons whereby they move in unison.

27. The combination according to claim 25, in which means are provided on said housing controlling segregation of said predetermined quantity of water and including a water inlet passageway connecting said one chamber of the pair to a source of water under pressure, and a valve assembly interposed in said inlet passageway and operable to admit water under pressure to said one chamber and to isolate said one chamber and the predetermined quantity of water segregated therein from said source when said one chamber is full of water.

28. The combination according to claim 27, in which said valve assembly includes a valve member moveable to open or close said inlet passageway, and means are disposed between said valve member and said piston operative to move said valve member to close said inlet passageway when said piston reaches the limit of its displacement in one direction and effect opening of said valve member to open said inlet passageway when said piston reaches the limit of its displacement in the opposite direction.

29. The combination according to claim 28, in which said means disposed between said valve member and said piston includes an elongated rod having an enlargement at one end adapted to be engaged by a restriction on the piston to close said valve member and an auxiliary valve structure on its other end associated with said valve member.

30. The combination according to claim 25, in which said means controlling delivery of said portion of said segregated predetermined quantity of water to said collection recess, opening and closing said evacuation gate, delivering the remaining portion of said segregated predetermined quantity of water to said collection recess and thereafter delivering air under pressure to said evacuation chamber while segregating another predetermined quantity of water in said one chamber, includes:

(a) an activating valve assembly selectively operable to open a discharge path for delivery of said segregated predetermined quantity of water to said collection recess;

(b) means in said housing to effect displacement of said piston in a direction to discharge water from said one chamber through said discharge path and into said collection recess;

(c) means operatively associated with said other chamber of the pair controlling the ingress of air thereto whereby a negative pressure is produced therein for a predetermined interval by movement of the piston to discharge the water from said one chamber;

(d) means operatively associated with said evacuation gate acturated by said negative pressure in said other chamber to open said evacuation gate and hold it open so long as said negative pressure is maintained and close said evacuation gate at the end of said predetermined interval; and (e) means operatively associated with said other chamber of the pair controlling egress of air therefrom whereby air therewithin is pressurized and delivered to said evacuation chamber during the interval that said one chamber is segregating another predetermined quantity of water.

31. The combination according to claim 30, in which said activating valve assembly includes:

(a) an outlet passageway in said housing;

(b) a valve chamber surrounding said outlet passageway;

(c) a diaphragm disposed in said valve chamber and displaceable to open or close said outlet passageway, said diaphragm having a restricted aperture therethrough permitting water to pass to the side of said diaphragm opposite said outlet passageway to thereby displace the diaphragm to close the outlet passageway;

(d) a water discharge passageway connecting said valve chamber with the collection recess in said toilet bowl;

(e) an auxiliary passageway connecting said water discharge passageway with said valve chamber on the side thereof opposite said outlet passageway;

(f) micro-valve means in said auxiliary passageway moveable to open or close said auxiliary passageway;

(g) a rod connected to said micro-valve means and movable to actuate said micro-valve means to open said auxiliary passageway to drain water from said valve chamber from the side of said diaphragm opposite said outlet passageway to thereby reduce the pressure of water on the side of the diaphragm opposite the outlet passageway to thereby permit displacement of the diaphragm to open said outlet passageway; and (h) means including an auxiliary air chamber and an auxiliary diaphragm therewithin connected to said micro-valve by said rod to retain the micro-valve open during delivery of water to said collection recess and close the micro-valve during segregation of said predetermined quantity of water.

32. The method of flushing waste products from a toilet bowl having a base portion divided into a waste product collection recess and a waste product evacuation chamber and including an opening providing communication between said waste product collection recess and said waste product evacuation chamber and an evacuation gate normally covering said opening, comprising the steps of:

(a) segregating from a source thereof a predetermined quantity of water;

(b) delivering said segregated predetermined quantity of water to the waste product collection recess of the toilet bowl over a predetermined water delivery interval;

(c) during said predetermined water delivery interval opening said normally closed evacuation gate to flush waste products from said collection recess into said evacuation chamber;

(d) thereafter closing said evacuation gate; and then (e) delivering air under pressure to said evacuation chamber while simultaneously segregating from said source thereof another predetermined quantity of water; and (f) segregating air from the ambient atmosphere into an expanding volume simultaneous to delivery of said segregated predetermined quantity of water to said collection recess.

33. The method of flushing waste products from a toilet bowl having a base portion divided into a waste product collection recess and a waste product evacuation chamber and including an opening providing communication between said waste product collection recess and said waste product evacuation chamber and an evacuation gate normally covering said opening, comprising the steps of:

(a) segregating from a source thereof a predetermined quantity of water;

(b) delivering said segregated predetermined quantity of water to the waste product collection recess of the toilet bowl over a predetermined water delivery interval;

(c) during said predetermined water delivery interval opening said normally closed evacuation gate to flush waste products from said collection recess into said evacuation chamber;

(d) thereafter closing said evacuation gate; and then (e) delivering air under pressure to said evacuation chamber while simultaneously segregating from said source thereof another predetermined quantity of water;

(f) said toilet bowl being equipped with a housing having a hollow interior divided into a water receiving chamber for receiving and segregating said predetermined quantity of water, and an air compression chamber within which air is pressurized and from which it is delivered to said evacuation chamber; and (g) sucking air from the ambient atmosphere into said air compression chamber simultaneous to expulsion of water from said water receiving chamber.

* * * * *